United States Patent [19]

Kohler et al.

[11] Patent Number: 4,573,634

[45] Date of Patent: Mar. 4, 1986

[54] TAMPER-EVIDENT CARTON

[75] Inventors: Karl A. Kohler, Roselle; Richard F. House, St. Charles, both of Ill.

[73] Assignee: Container Corporation of America, Chicago, Ill.

[21] Appl. No.: 724,824

[22] Filed: Apr. 18, 1985

[51] Int. Cl.[4] ..... B65D 5/08

[52] U.S. Cl. ..... 229/38; 206/620; 206/807; 229/41 B

[58] Field of Search ..... 206/247, 807, 604, 620; 229/37 R, 38, 41 R, 41 B, 44 R

[56] References Cited

U.S. PATENT DOCUMENTS

| | | | |
|---|---|---|---|
| 221,244 | 11/1879 | Matchett | 220/416 |
| 234,221 | 11/1880 | Arthur | 229/38 |
| 309,052 | 12/1884 | Hohenstein | 229/38 |
| 436,141 | 9/1890 | Lohmann | 229/38 |
| 462,713 | 11/1891 | Keith | 229/38 |
| 610,474 | 9/1898 | Cowles | 229/38 |
| 2,349,605 | 5/1944 | Becker | 229/37 R |
| 4,050,625 | 9/1977 | Rice et al. | 229/38 |
| 4,479,588 | 10/1984 | Davis et al. | 206/807 |

*Primary Examiner*—William Price
*Assistant Examiner*—Gary E. Elkins
*Attorney, Agent, or Firm*—Richard W. Carpenter

[57] ABSTRACT

A one piece tamper-evident paperboard carton having overlapped end flaps secured to each other in such a way that the ends of the carton cannot be opened without tearing the paperboard so that observation of the carton would indicate that it had been previously opened.

3 Claims, 8 Drawing Figures

TAMPER-EVIDENT CARTON

BACKGROUND OF THE INVENTION

1. Field of the Invention

This invention relates generally to folding cartons, and more particularly to a carton having closure means which prevents the carton from being opened without at least a partial destruction of the integrity of the carton to indicate that it has been opened.

2. Description of the Prior Art

A prior art search conducted in the United States Patent and Trademark Office and directed to the subject matter of this application disclosed the following United States Letters Patent:

| | | | |
|---|---|---|---|
| RE. 23,670 | 3,893,614 | 3,724,741 | 3,511,431 |
| 3,095,135 | 2,485,235 | 2,041,932 | |

None of the prior art patents uncovered in the search discloses an end loading top opening carton wherein the closure means at each end of the carton includes a novel intermediate flap arrangement like that of the present invention which permits the carton to be partially glued by the manufacturer, filled by the packer, and then sealed by the packer in such a manner that any subsequent attempt to open the carton would be apparent because of physical damage to the carton.

SUMMARY OF THE INVENTION

It is an object of this invention to provide, in an end loading, end opening, paperboard carton, a closure arrangement for each end of the carton which prevents the carton from being opened without at least a partial destruction of the integrity of the carton.

Another object of the invention is the provision, in a carton of the type described, of a closure arrangement which will permit the manufacturer to partially glue the carton before shipping to the packer, so that one end of the carton can be closed sufficiently to permit the packer to load the carton and then further close and seal both ends of the carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
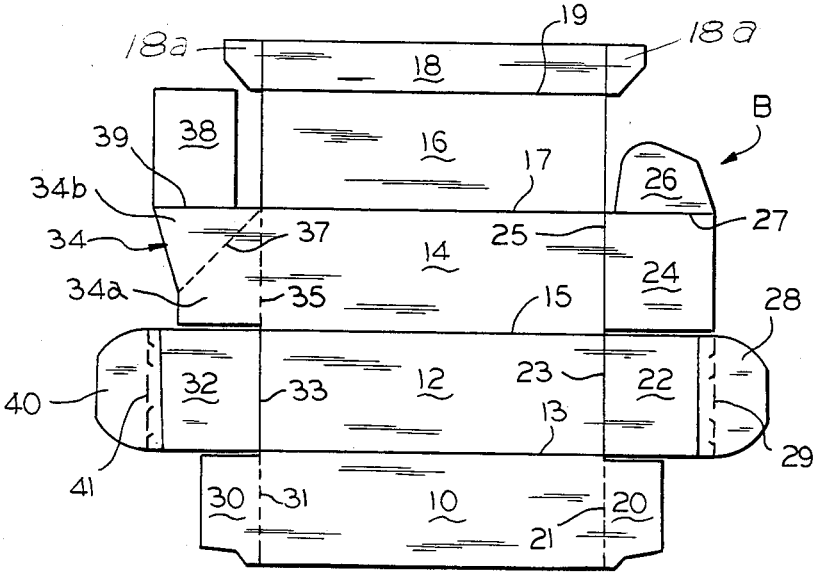
FIG. 1 is a plan view of the inner surface of a blank of foldable sheet material from which the carton illustrated in the other views may be formed.

Referring now to the drawings for a better understanding of the invention, it will be seen that the carton, indicated generally at C and illustrated at FIGS. 5–8, may be formed from the unitary blank B of foldable sheet material illustrated in FIG. 1 of the drawings.

The main portion or body of the carton includes a first side wall panel 10, a second or rear side wall or panel 12, a third side wall panel 14, a fourth or front side wall panel 16, and a glue panel 18, all of which are foldably joined to each other along parallel fold lines 13, 15, 17, and 19, respectively, to form a tubular structure open at the ends.

The closure means at one end of the carton, usually the lower end if the carton is filled from the top, is illustrated at the left sides of FIGS. 1–4. This closure arrangement includes an intermediate closure flap 30, foldably joined along a weakened tear line 31 to an adjacent edge of first side wall panel 10; an outer closure flap 32, foldably joined along a fold line 33 to an adjacent edge of second side wall panel 12; and an inner closure flap 34 comprising a pair of generally triangular first and second sections **34*a* and 34*b*, respectively, which is foldably joined along a fold line 35 to an adjacent edge of third side wall panel 14**.

Inner closure flap first and second sections **34*a* and 34*b* are foldably joined to each other along a diagonal fold line 37. Second flap section 34*b* has foldably joined to a side edge thereof, along a fold line 39, a retaining flap or panel 38**.

A tuck flap 40 is foldably joined to the outer edge of outer closure flap 32 along a weakened line of tear 41.

Now turning to the right hand sides of the views of FIGS. 1–4, it will be seen that the closure arrangement for the other end of the carton includes an intermediate closure flap 20, foldably joined along a weakened tear line 21 to an adjacent edge of first side wall panel 10; an outer closure flap 22, foldably joined along a fold line 23 to an adjacent edge of second side wall panel 12; and an inner closure flap 24, foldably joined along a fold line 25 to an adjacent edge of third side wall panel 14.

Inner closure flap 24, has foldably joined to a side edge thereof, along a fold line 27, a tuck tab 26. A tuck flap 28 is foldably joined along a weakened line of tear 29 to the outer free edge of outer closure flap 22.

Figure 4:
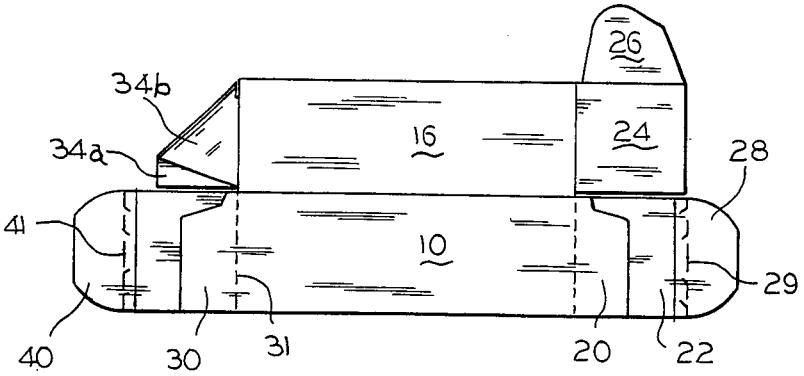

As previously indicated, the carton, after being formed by the manufacturer, is shipped to the user or packer in a flat, partially glued condition, as illustrated in FIG. 4.

Figure 2:
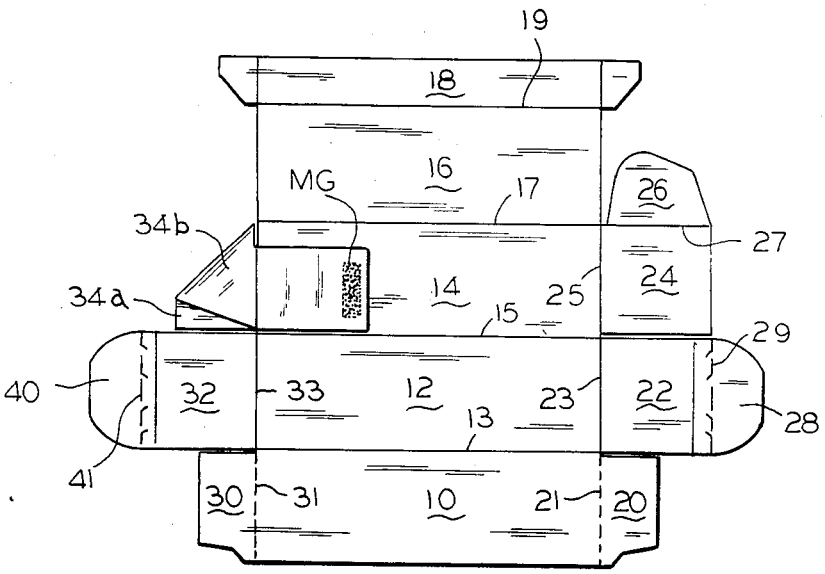
FIGS. 2, 3, and 4 are views similar to FIG. 1, but illustrate various sequential steps in the folding operation by which the carton is formed.
Figure 3:
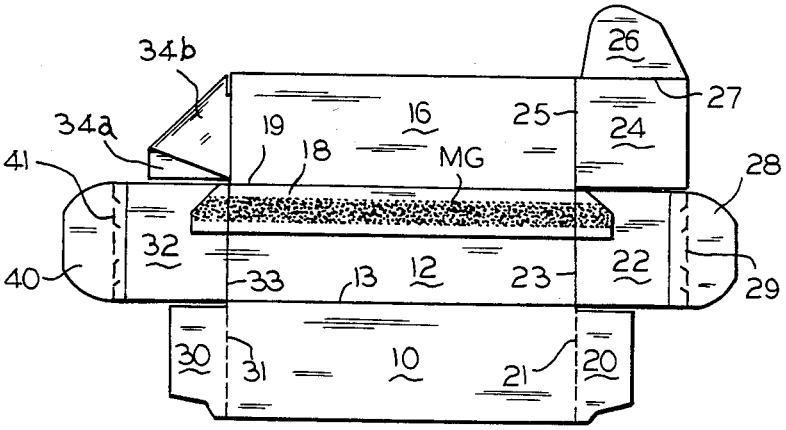

In the formation of the carton, referring now to FIG. 2, it will be seen that the second or outer section **34*b* of inner closure flap 34 is folded 180 degrees to overlie first section 34*a* with retaining flap 38 overlying an end area of third side wall panel 14**.

An adhesive, indicated generally at MG, is applied to outer surface of retaining flap 38, so that when fourth side wall panel 16 is subsequently folded 180 degrees to overlie retaining flap 38 and third side wall panel 14, retaining flap 38 will be secured to fourth side wall panel 16.

Another strip of adhesive, also indicated generally at MG, is applied by the manufacturer to the outer surface of glue panel 18 and extensions **18*a*, so that when first side wall panel 10 is folded 180 degrees to overlie glue panel 18 and second side wall panel 12, glue panel 18 will be secured to first side wall panel 10 and extensions 18***a* to respective inner closure flaps 20 and 30, to form a tubular structure.

Figure 5:
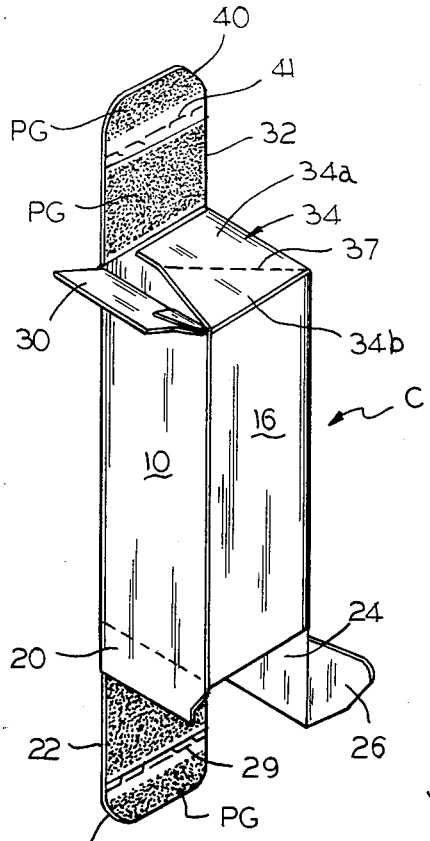
FIG. 5 is a fragmentary perspective view of a carton embodying features of the invention, which has been erected but before the ends thereof have been closed.

When the packer receives the carton from the manufacturer, it is in the collapsed condition illustrated in FIG. 4. As best seen in FIG. 5, the novel bellows arrangement created by the two sections 34*a* and 34*b*, which are foldably joined to each other along diagonal fold line 37, causes the inner flap to close the end of the carton as the carton is moved from collapsed to erected condition. The purpose of having this inner flap in such a position is to permit the packer to load a product from the other end of the carton. The inner flap will hold the product in the carton until the outer closure flaps have been secured in position.

Figure 6:
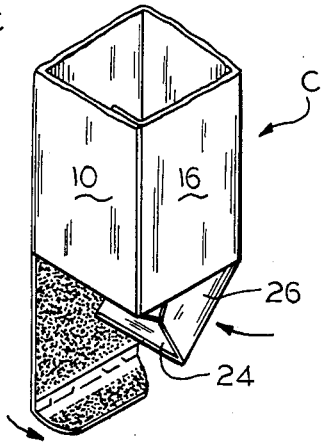
FIG. 6 is a view illustrating a portion of the structure shown in FIG. 5, but with one end of the carton shown in a more advanced stage of closing.
Figure 7:
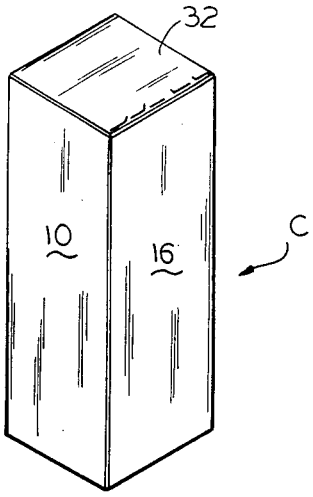
FIG. 7 is a perspective view of a closed and sealed carton embodying features of the invention.

Prior to closing the lower end of the carton as illustrated in FIG. 5, the tuck tab 26 is folded at right angles to the inner closure flap 24, so that when the inner closure flap 24 is folded at right angles to the center side wall panel 14, the tuck tab will be positioned against the inner surface of fourth side wall panel 16, as illustrated in FIG. 6.

For the final closing and sealing of the carton, adhesive indicated generally at PG is applied by the packer to the inner surfaces of both of the outer closure flaps 22 and 32 and related tuck flaps 28 and 40.

The closure flaps are folded over into overlapping relation with related inner and intermediate closure flaps and secured thereto. At the same time, tuck flaps 28 and 40 are folded over and tucked into the carton behind the carton side wall panel and respective tuck tab 26 and retaining flap 38 and secured to the outer surfaces thereof.

It will be noted that the areas at the corners of the carton where the outer closure flaps 22 and 32 are joined to their respective tuck flaps 28 and 40 are free from glue. It will also be noted that the outer closure flaps are joined to their respective tuck flaps by weakened lines of tear. The purpose of this is to make it extremely difficult to attempt to open either end of the carton without breaking one of the weakened lines of tear in such a way as to indicate that the carton has been opened.

Figure 8:
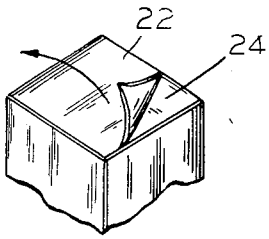
FIG. 8 is a fragmentary view similar to FIG. 1, but illustrating the manner in which one end of the carton may be opened.

When it is desired to open the carton, outer closure flap is 22 torn away, as illustrated in FIG. 8, and inner closure flap 24 pulled up to expose and make available the contents of the carton.

Thus, the carton provides a novel closure flap arrangement which makes it easy for the packer to fill the carton and then seal it in such a way as to prevent the opening of the carton without the partial destruction of the integrity of the carton. This is extremely important in cartons for pharmaceutical and other products designed for human consumption.

What is claimed is:

1. An end loading, end opening, tubular, tamper-evident carton formed from a unitary blank of foldable sheet material such as paperboard, comprising:

(a) a pair of opposed front and rear side wall panels and a second pair of opposed side wall panels foldably joined to each other along parallel, longitudinal fold lines to form a tubular structure open at the ends;

(b) first and second closure means for closing the opposite ends of said structure in such a manner that neither end can be opened without destroying the integrity of the carton;

(c) said first closure means including:

(i) a first inner closure foldably joined to and extending normally from a side wall panel of said second pair;

(ii) a first retaining panel foldably joined to a front edge of said first inner closure flap, extending inwardly therefrom behind said front side wall panel, and having an end portion secured to said front side wall panel;

(iii) a first intermediate closure flap foldably joined to and extending normally from the other side wall of said second pair and being disposed to overlie a portion of said first inner closure flap;

(iv) a first outer closure flap foldably joined at one edge to and extending normally from said rear side wall panel;

(v) said first outer closure flap being adhesively secured to outer surfaces of said first inner and intermediate closure flaps and having foldably joined thereto at an opposite edge thereof a tuck tab which is interposed between said front side wall panel and said first retaining panel and adhesively secured to an outer surface of the latter;

(d) said second closure means including:

(i) a second inner closure flap foldably joined to and extending normally from a side wall panel of said second pair;

(ii) a second retaining panel foldably joined to a front edge of said second inner closure flap and extending inwardly therefrom behind said front side wall panel;

(iii) a second intermediate closure flap foldably joined to and extending normally from the other side wall panel of said second pair and being disposed to overlie a portion of said second inner closure flap;

(iv) a second outer closure flap foldably joined at one edge to and extending normally from said rear side wall panel;

(v) said second outer closure flap being adhesively secured to outer surfaces of said second inner and intermediate closure flaps and having foldably joined thereto at an opposite edge thereof a tuck tab which is interposed between said front side wall panel and said second retaining panel and adhesively secured to the latter.

2. A carton according to claim 1, wherein said first inner closure flap includes a pair of generally triangular flap sections foldably joined to each other along a fold line which extends diagonally outward from the fold line joining said first inner panel to its related side wall panel.

3. An end loading, end opening, tubular, tamper-evident carton formed from a unitary blank of foldable sheet material such as paperboard, comprising:

(a) a pair of opposed front and rear side wall panels and a second pair of opposed side wall panels foldably joined to each other along parallel, longitudinal fold lines to form a tubular structure open at the ends;

(b) first and second closure means for closing the opposite ends of said structure in such a manner that neither end can be opened without destroying the integrity of the carton;

(c) each of said closure means including:

(i) an inner closure flap foldably joined to and extending normally from a side wall panel of said second pair;

(ii) a retaining panel foldably joined to a front edge of said second inner closure flap and extending inwardly therefrom behind said front side wall panel;

(iii) said retaining panel having an end portion adhesively secured to an inner surface of said front side wall panel;

(iv) an intermediate closure flap foldably joined to and extending normally from the other side wall panel of said second pair and being disposed to overlie a portion of said second inner closure flap;

(v) an outer closure flap foldably joined at one edge to and extending normally from said rear side wall panel;

(vi) said outer closure flap being adhesively secured to outer surfaces of said second inner and intermediate closure flaps and having foldably joined thereto at an opposite edge thereof a tuck tab which is interposed between said front side wall panel and said second retaining panel and adhesively secured to the latter.

* * * * *